United States Patent [19]

Lidström

[11] 4,077,440

[45] Mar. 7, 1978

[54] REINFORCEMENT ELEMENTS FOR ELONGATE CONCRETE BUILDING BLOCKS MANUFACTURED BY SLIDING FORM CASTING AND A METHOD AND A MACHINE TO PRODUCE SUCH ELEMENTS

[75] Inventor: Thony Göte Lidström, Molndal, Sweden

[73] Assignee: Nilcon Engineering AB, Kallered, Sweden

[21] Appl. No.: 627,938

[22] Filed: Nov. 3, 1975

[51] Int. Cl.[2] ..... B21F 27/04

[52] U.S. Cl. ..... 140/105; 140/24; 140/115

[58] Field of Search ..... 140/71 R, 105, 115, 140/102, 104, 112, 7, 24; 52/723

[56] References Cited

U.S. PATENT DOCUMENTS

| | | | |
|---|---|---|---|
| 180,745 | 8/1876 | Braddock | 140/24 |
| 1,394,796 | 10/1921 | Smith | 140/71 |
| 1,784,318 | 12/1930 | Swanbaum | 140/115 |
| 1,933,189 | 10/1933 | Schlagintweit | 140/71 |
| 3,303,315 | 2/1967 | Smith et al. | 140/112 |
| 3,405,743 | 10/1968 | Robinson | 140/112 |
| 3,443,495 | 5/1969 | Heltzel | 404/100 |
| 3,497,579 | 2/1970 | Barron | 249/20 |
| 3,611,665 | 10/1971 | O'Brien | 52/723 |
| 3,827,132 | 8/1974 | Bratchell | 29/452 |

*Primary Examiner*—Lowell A. Larson
*Attorney, Agent, or Firm*—Harness, Dickey & Pierce

[57] ABSTRACT

A reinforcement element intended for essentially U-shaped elongate building blocks manufactured by using the sliding form casting technique. The reinforcment element consists of a plurality of first pretensioned equidistantly spaced steel wires deposited in the longitudinal direction of the block, above or below which wires is positioned, in parallel therewith, a wire net composed of two longitudinal wires and a plurality of equidistantly spaced transverse cross rods the ends of which are bent about the longitudinal wires. The invention likewise concerns a method and a machine to produce such reinforcement elements.

10 Claims, 21 Drawing Figures

62
63
57
XVII
64
17
66
65
58
52
18
13
6
48
55
61
XVII
60

63
55
62
64
65
6
13
18
17
52
57
59

57
57
53
52
66
56
56
54
54
6
48
55
55
49
50
51

13
18
6
6
18

13
6
6
73

13
6

XIX
6
13
69
XIX

REINFORCEMENT ELEMENTS FOR ELONGATE CONCRETE BUILDING BLOCKS MANUFACTURED BY SLIDING FORM CASTING AND A METHOD AND A MACHINE TO PRODUCE SUCH ELEMENTS

BACKGROUND OF THE INVENTION

The present invention concerns improved reinforcement elements for elongate concrete building blocks manufactured by sliding form casting. The invention primarily concerns building blocks of coffer shape provided with a concrete slab covering the block.

SUMMARY OF THE INVENTION

The characteristic and novel features of the invention reside in the reinforcement element of the building block consisting of a number of pre-tensioned steel wires extending in the longitudinal direction of the block, as well as of an elongate net which is arranged in parallel with the steel wires in a position above or below these wires, said net comprising a pair of longitudinally extending wires, and transverse wires of rods extending transversely across the longitudinal wires at equidistantly spaced locations, the wire or rod ends being bent around the two last-mentioned longitudinal wires. Owing to the combination of the pre-tensioned steel wires and the net, the longitudinally extending wires of which may also be pre-tensioned, the reinforcement element may easily be deposited across the bed on which the concrete block is to be manufactured while using the sliding form casting technique.

The invention likewise concerns a method of manufacturing the net incorporated in the reinforcement element. The method is characterised by stepwise advancing two steel wires in parallel with one another in the intended longitudinal direction of the element and spaced a certain distance apart, feeding transverse cross rods having a length exceeding the distance between the longitudinally extending wires towards and against said longitudinal wires in such a manner that both ends of the cross rods extend beyond the longitudinal wires and in such a manner that the cross rods will be positioned at a certain mutual distance, and bending the cross rod ends about the longitudinal wires.

The manufacture of the net may be carried out in a completely automated way from three annular wire bundles.

The invention likewise comprises a machine to perform the method outlined above.

BRIEF DESCRIPTION OF THE DRAWINGS

The invention will be described more in detail in the following with reference to the accompanying, partly diagrammatical drawings, wherein.

DETAILED DESCRIPTION OF A PREFERRED EMBODIMENT

Figure 4:
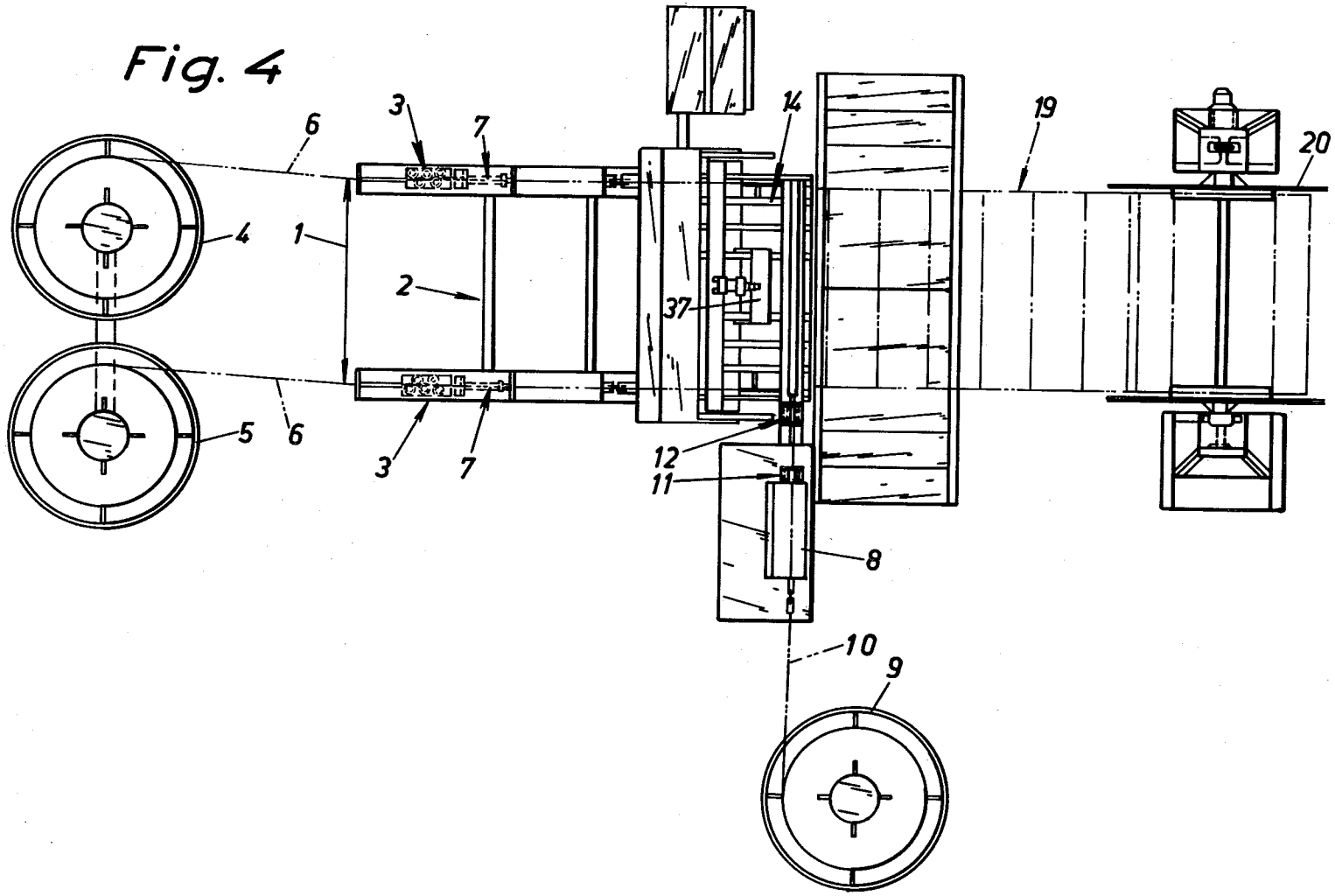
FIG. 4 is a plan view of a machine for the manufacture of the net forming part of the reinforcement.
Figure 5:
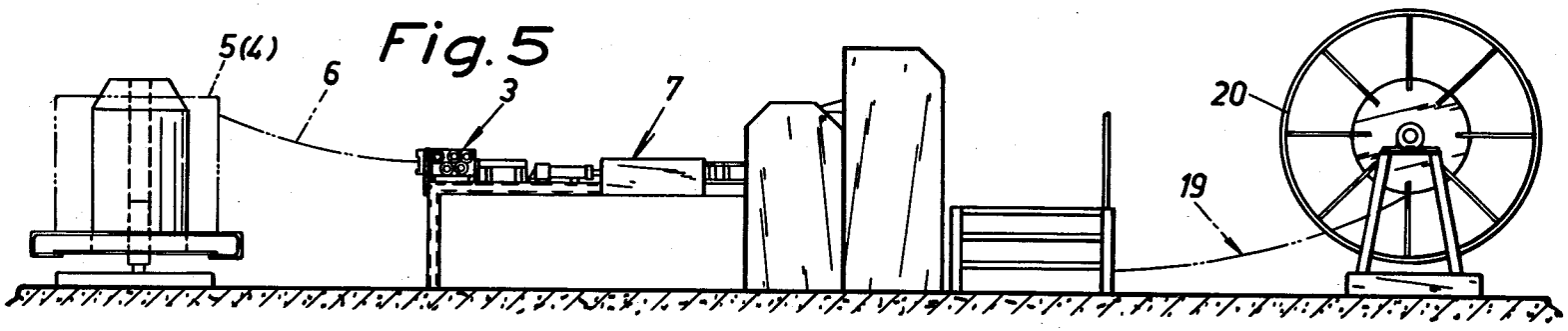
FIG. 5 is a side view of the machine of FIG. 4.
Figure 6:
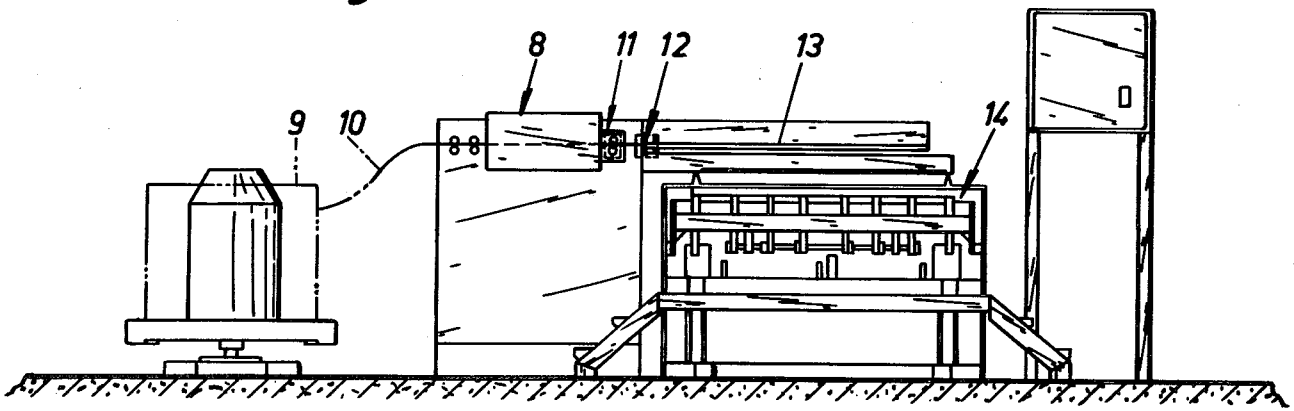
FIG. 6 is an end view of said machine as seen from the right in FIG. 5.
Figure 12:
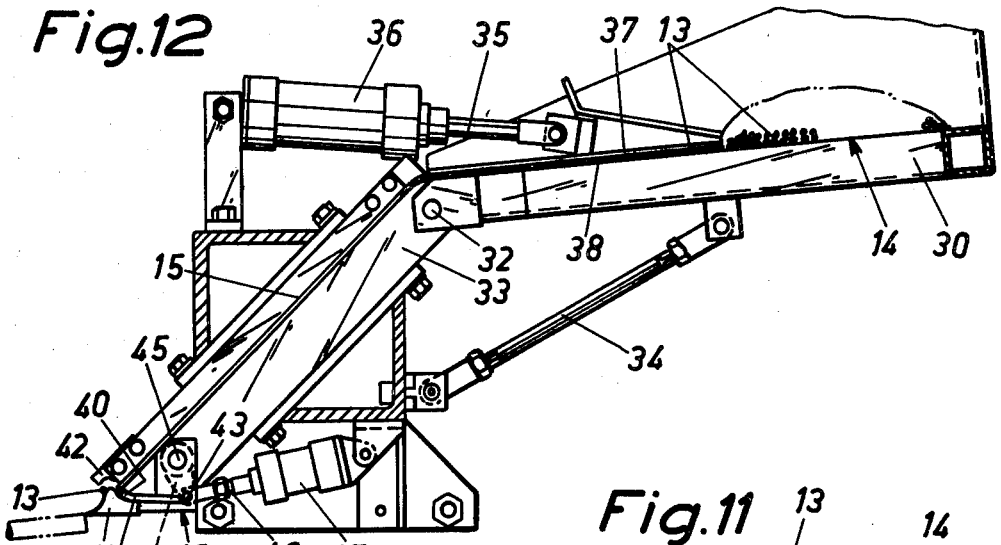
FIG. 12 is a vertical sectional view along line XII—XII of FIG. 11.

The machine illustrated in FIGS. 4 – 6 for the manufacture of the reinforcement net includes two members 3 supported in the machine stand 2 at a mutual dstance 1 from one another and intended to straighten two steel wires 6 which are wound off two wire reels 4, 5, and also two associated members 7 to feed the wires 6 stepwise. The machine likewise comprises a similar member 8 to straighten a steel wire 10 which is wound off a wire reel 9, and a means 12 to sever the wire 10 into cross rods 13 (see FIGS. 20, 21) having a length which slightly exceeds the distance 1 separating the two longitudinal wires 6. There is a supply table 14 to support the cross rods 13 (FIG. 12) and a sloping ramp 15 connected to the table, and also a device 16 arranged to discharge one cross rod 13 at a time onto the two longitudinal wires 6. Finally, the machine also comprises two means 17 (FIGS. 15 and 16) to bend the free ends 18 of the cross rods 13 about their associated wire 6. The finished wire net 19 is wound onto a reel 20 (FIG. 4).

The Wire Straightening Members

The wire straightening members 3 are of a known design and comprise a number of rotatably driven supply rollers 21 which are positioned in rows in a vertical plane, and a number of rotatably mounted supply rollers 22 arranged in rows for movement in a horizontal plane, between which rows of rollers 21, 22 each longitudinal wire 6 is carried in order to be straightened.

The Wire Feed Members

Figure 7:
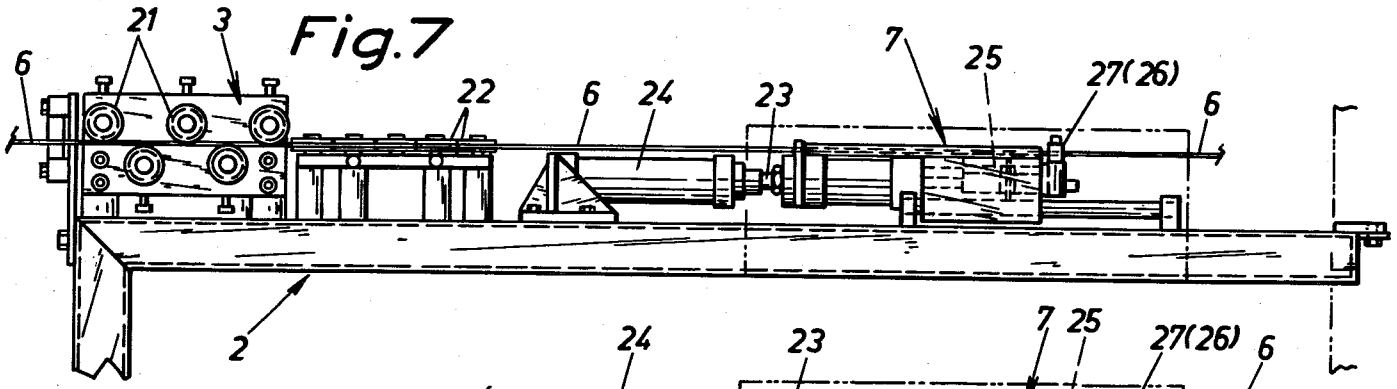
FIG. 7 illustrates on an enlarged scale an apparatus for feeding the two longitudinal wires incorporated in the net.
Figure 8:
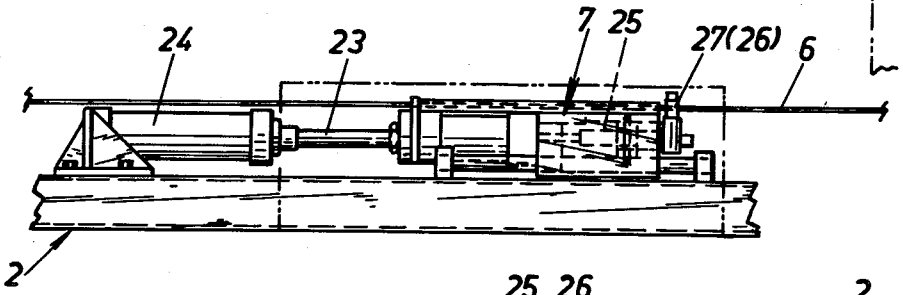
FIG. 8 is a side view of the gripper means of said apparatus, displaced one step to the right, as compared with FIG. 7.
Figure 9:
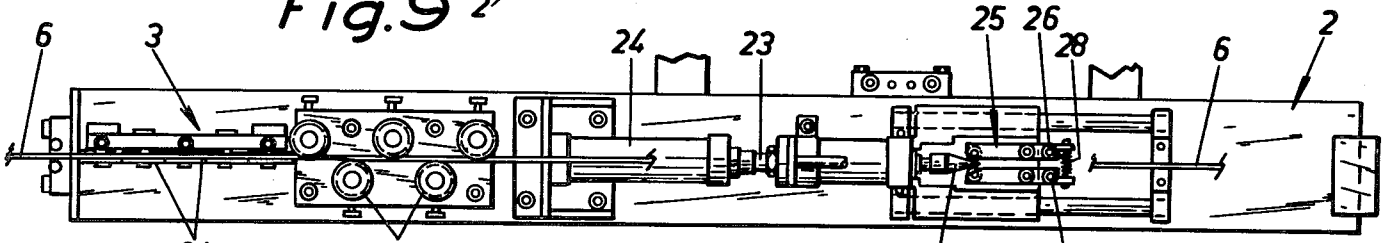
FIG. 9 is a plan view of the apparatus in accordance with FIG. 7 with the gripper means in release position.
Figure 10:
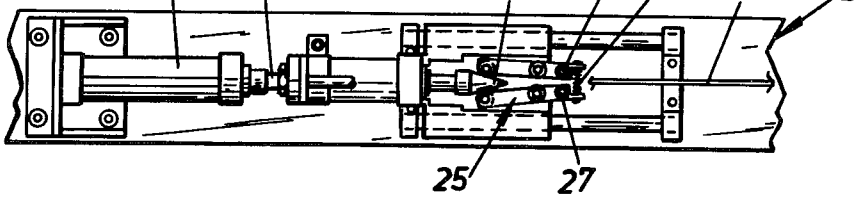
FIG. 10 is a plan view showing the gripper means in its operative position.

Also the wire feed members 7 are of known design. They consist each one of a gripper means 25 which is advanced step by step by a piston-and-cylinder unit 23, 24 and which is provided with two jaws 26, 27 which are moved apart by the action of a spring 28 and which are made to grip the wire 6 by an axially displaceable mandrel 29 such that the wire, upon displacement of the gripper means by the piston-and-cylinder unit 23, 24 to the right in accordance with FIG. 9, is fed over a corresponding distance into the machine. Upon retraction of the mandrel 29 to its original position (the left position in FIG. 9) the jaws 26, 27 release the wire 6 and the gripper means 26 may now in idle be returned to the original position (FIG. 7) by the piston-and-cylinder unit 23, 24.

The member 8 to straighten the wire 10 and the member 11 for feeding said wire are imagined to be of the same construction as those described for members 3 and 7.

The Means For Downwards Feeding of the Cross Bars

Figure 11:
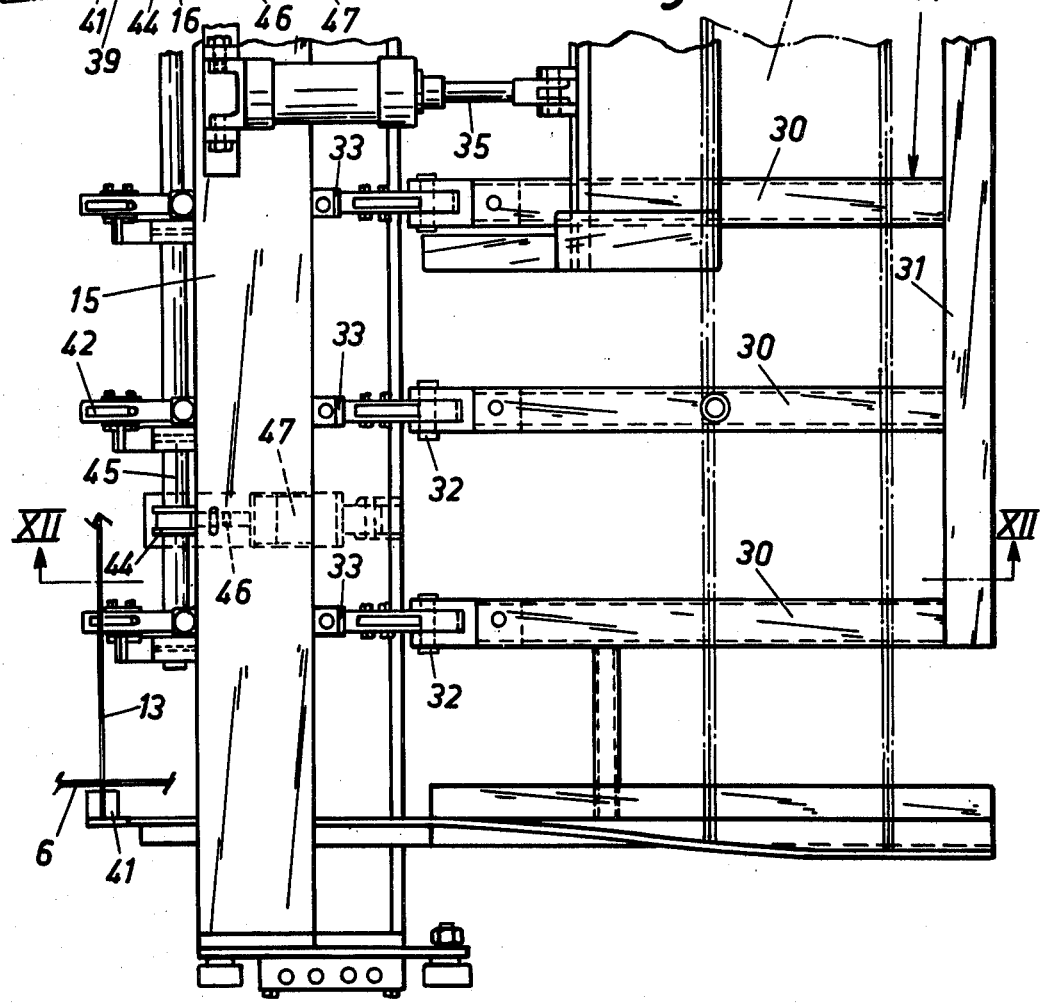
FIG. 11 is a plan view of the right side of the machine as seen from the direction of feeding of the longitudinal wires and illustrating the place where the transverse wires, the cross rods, are to be inserted into the machine.

The supply table 14 on which the cross rods 13 are to be supported is imagined composed of a number of beams 30 extending in the longitudinal direction of the machine (FIGS. 11, 12) and interconnected at one of their ends by a crosswise beam 31. The opposite end of the table 14 is pivotally mounted about coaxial bolts 32 arranged in the machine stand 33 and by means of extensible stays 34 the table 14 may be tilted into various positions of inclination. The sloping ramp 15 is attached to the lower edge of the table 14. Above the table 14 is mounted a feeder plate 37 for displacement to and fro by a piston-and-cylinder unit 35, 36, said plate sliding above a storage 38 of cross rods 13 supported on the table. Through the displacement of the plate 37 to and fro is ensured that cross bars 13 are continuously fed down onto the sloping ramp 15.

The Cross Rod Discharge Means

The means 16 to discharge the cross rods 13, one by one, from the sloping ramp 15 comprises a pusher member in the form of a link 39 the free end 40 of which cooperates with guide shoulders 41, positioned one at either side of the machine, spaced apart a distance which essentially agrees with the length of the cross rods 13 and which distance thus exceeds the distance 1 between the two longitudinal wires 6. The guide shoulders are positioned below the lower end 42 of the ramp 15 at a distance from the latter which is somewhat larger than the thickness of one cross rod 13. By means of a pivot bolt 43 the link 39 is articulated to an arm 44 (a similar arm naturally is provided at the opposite side of the machine) which is pivotable about a horizontal shaft 45. The arm 44 may be swung by means of a piston-and-cylinder unit 46, 47 in such a manner that the free end 40 of the link 39 is displaced upwards along the guide shoulders 41, past the lower end of the ramp 15, and in doing so pushing out the one of the cross rods 13 which at that moment is in the lowermost position on the ramp.

The Bending Means

From the discharge means 16 the cross rods 13 roll rearwards to the bending means 17 which are positioned one on either side of the machine and arranged in a mirror image fashion relative to one another. The bending means 17 — of which only the right one will be described herein — are provided with a nozzle 48 through which passes the associated longitudinal wire 6. The nozzle 48 is attached in one of two securement plates 49, 50 between which there is a gap 51 in which is movable a roller-shaped bending tool 52 in which is formed a peripheral circumferantial groove 53. The bending tool 52 is provided with two guide pins 54 which are arranged for movement in one angular groove 55 each, formed in the plates 49, 50. Externally of the guide pins 54 the bending tool 52 is provided with two coaxial mounting pins 56 by means of which the bending tool is supported by the lower end of two links 57, the upper end of which is articulated to a carriage 59 by means of a bolt 58, said carriage being displaceable upwards and downwards by means of a crank 61 driven by a cam disc 60. A cross beam 62 connects the carriage 59 with a similar carriage provided at the opposite side of the machine. The beam 62 is provided with a resilient abutment means 63 which serves as a hammer and cooperates with an anvil 64 which is arrranged to be urged against the cross rod 13 and the lower end 65 of which is positioned immediately below the longitudinal wire 6. Two springs 66 retain the anvil 64 in an upper position, out of contact with the cross rod 13.

Figure 13:
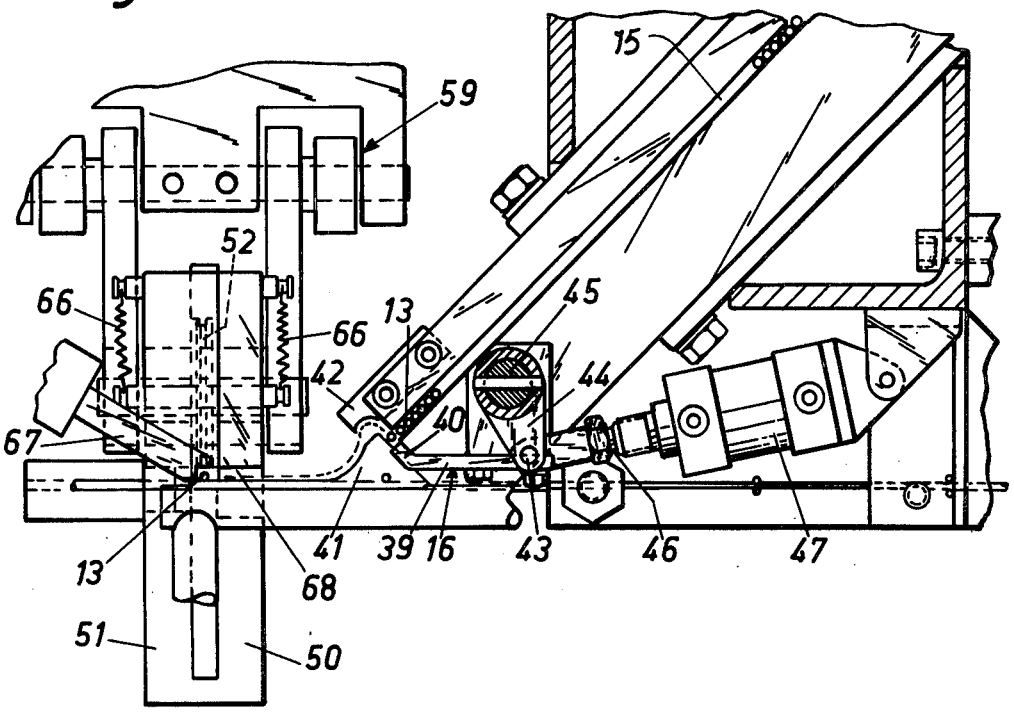
FIG. 13 shows a similar sectional view as the one in FIG. 12 but on a somewhat larger scale and including also a device to bend one end of the cross rods.
Figure 14:
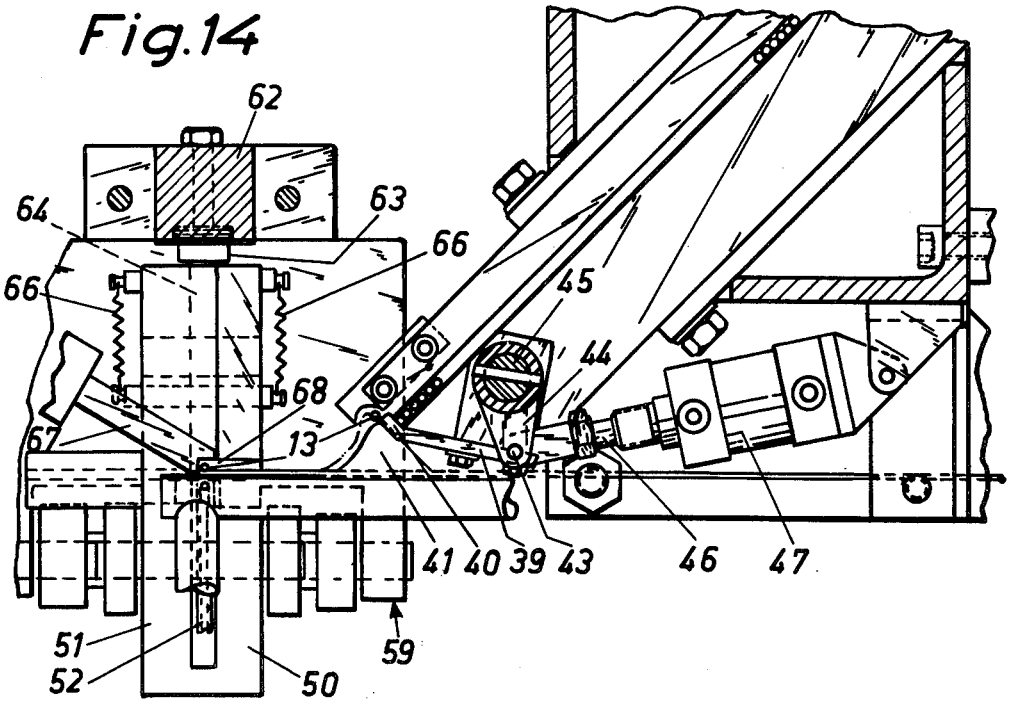
FIG. 14 is a sectional view similar to the one in FIG. 13 but showing the movable parts of the machine in a different operational stage.

The bending means 17 also comprise a permanent magnet 67 (FIGS. 13, 14) ensuring that the cross rod 13, fed into the means, will be positioned exactly opposite the bending tool 52 in a notch 68 formed in the plate 50 and open at its front.

Figures 15, 16, 17, 18, 19, 20, 21:
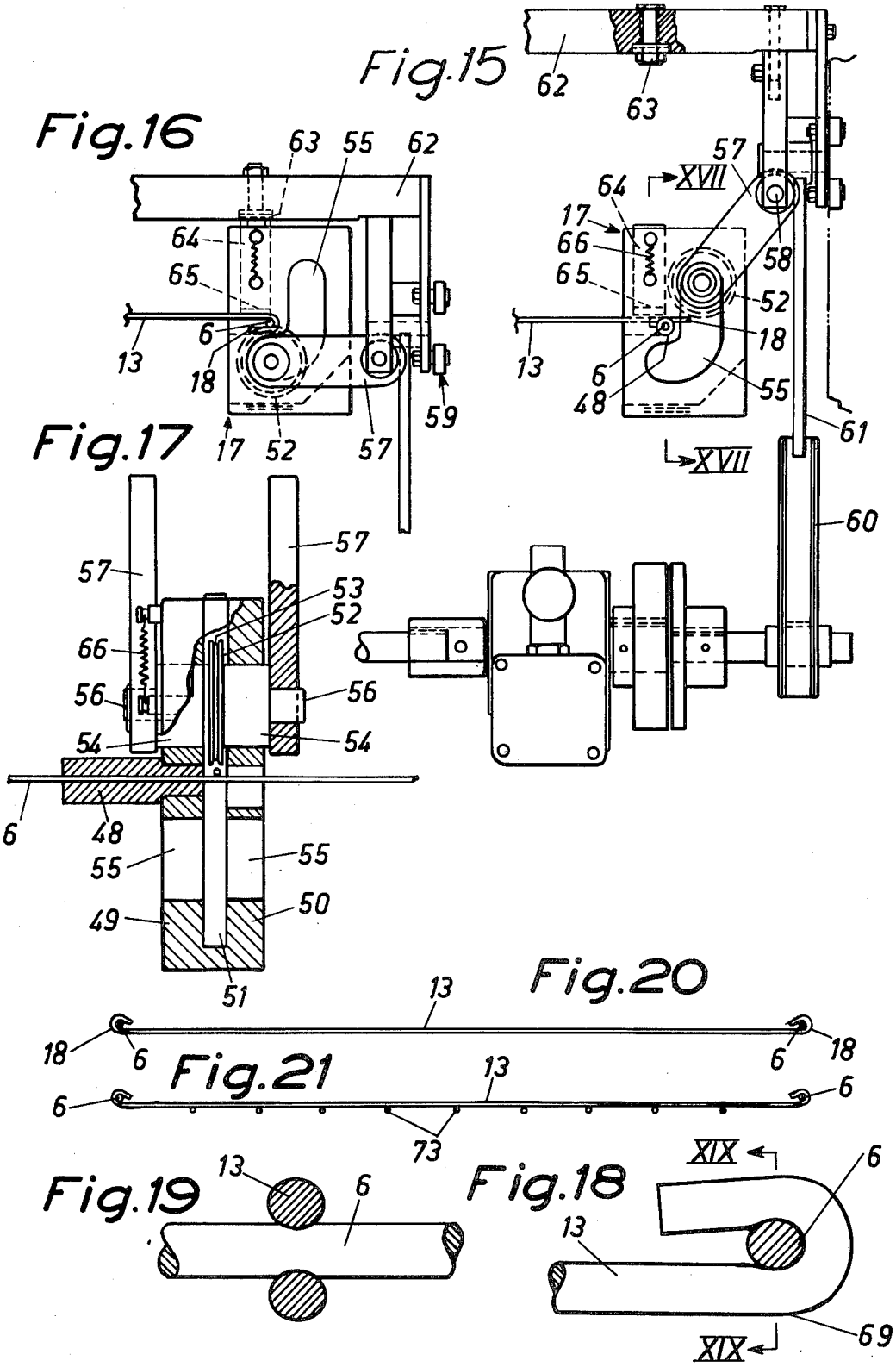
FIG. 15 is a side view of the bending means including the bending tool thereof in the position illustrated in FIG. 13.
FIG. 16 is a similar view but illustrating the bending tool in the position shown in FIG. 14 after completion of the bending of the cross rod end.
FIG. 17 illustrates on a somewhat enlarged scale a section through the bending tool along line XVII—XVII of FIG. 15.
FIG. 18 illustrates on an enlarged scale the cross rod end bent about a longitudinal wire.
FIG. 19 illustrates a vertical sectional view along line XIX—XIX of FIG. 18.
FIG. 20 shows a cross sectional view through the completed reinforcement net.
FIG. 21 is a similar cross sectional view but illustrating the net having been completed with the longitudinal pre-tensioned steel wires as shown in FIG. 3.

When the longitudinal wires 6 have been advanced sufficiently far for their front ends to pass through the nozzles 48 and when a cross rod 13, having been fed from the supply table 14 down on the sloping ramp 15 and discharged by the links 39, is in its correct position in the notch 68, the bending tool 52 is displaced by the links 57 from their upper position shown in FIG. 15 to the position illustrated in FIG. 16 wherein the ends 18 of the cross rods 13 are bent about their associated wires 6. Towards the end of the downwards movement of the carriage 59 and the beam 62, the hammer 53 hits its anvil 64 the lower end of which then brings about a slight downwards bend and deformation 69 (FIG. 21) of the cross rod 13, whereby the latter is efficiently clamped about the wire 6. After advancement of the longitudinal wires 6 one step a second cross rod is attached to the wires 6 in the manner just described and the process is repeated automatically until the required length of the net 19 is obtained. The net is reeled onto the reel 20.

Instead of cutting cross bars 13 off the wire 10 it is possible to position cross bars 13, which have previously been cut to the desired length, on the table 14.

The Casting Machine

Figure 3:
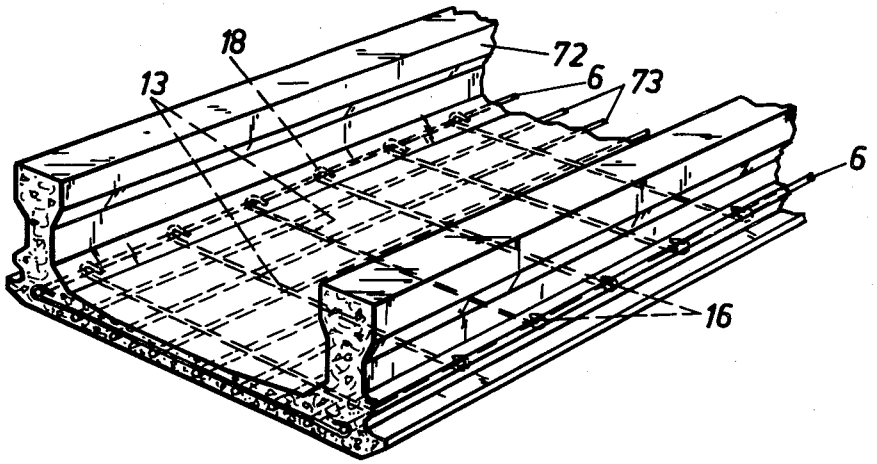
FIG. 3 illustrates in a perspective and partly cross-sectional view a concrete block in accordance with the invention.

In the longitudinal direction of an elongate bed 70 may be driven a cement casting machine to cast U-shaped beams 72 (FIG. 3). Above the bed 70 are stretched a number of laterally equidistantly spaced steel wires 73. The net 19 is rolled onto these wires 73 and also the longitudinal wires 6 of the net should be pre-tensioned.

Figure 1:
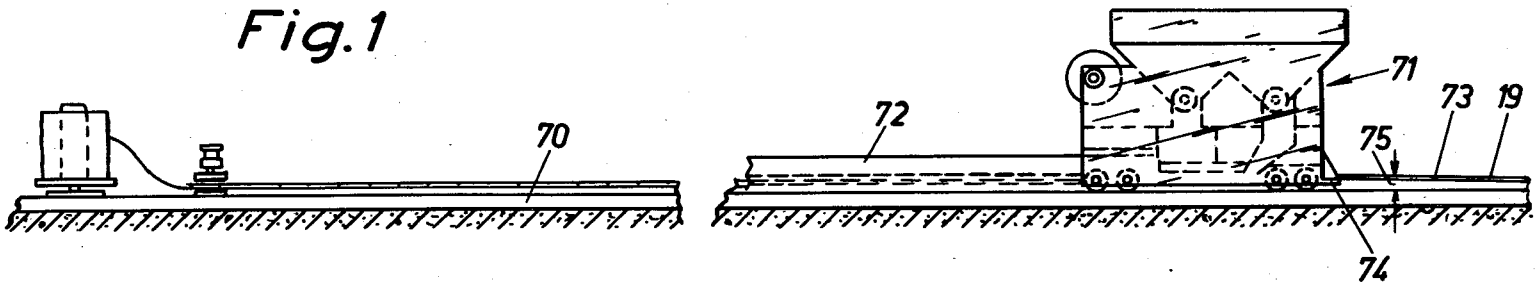
FIG. 1 is a side view of one end of an apparatus intended for the production of reinforced concrete beams in accordance with the present invention while using the sliding form casting technique.
Figure 2:
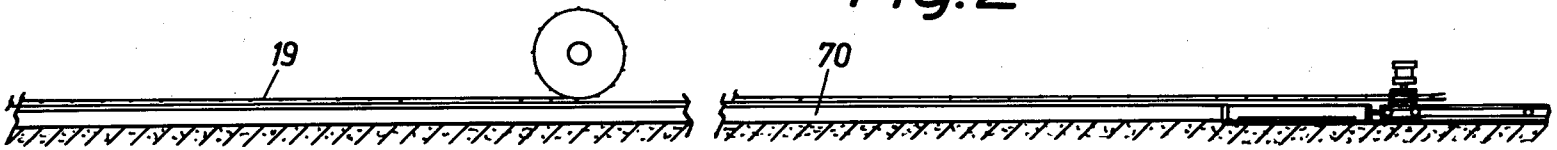
FIG. 2 is a side view of the opposite end of the bed of the apparatus, illustrating the manner of depositing the reinforcement net.

During the casting, the wires 73 and the net 19 are lifted by means of a crosswise rail 74 incorporated in the machine 71 whereby a predetermined distance 75 (FIG. 1) is obtained between the bed 70 and the wires 73 and the net 19. Consequently, the reinforcement will be well embedded in the cast compound.

The machine to produce the reinforcement net 19 may be constructively altered in a variety of ways within the scope of the invention. For instance, the wire straightening members 3 and 8 and the wire feed members 7 and 12 may be constructively altered in a variety of ways. Possibly, the net 19 may first be deposited on the bed and the wires 73 stretched above the net.

In the same manner as described is cast the elongate plate intended to cover the concrete beam 72.

What I claim is:

1. A method of manufacturing an improved reinforcement element comprising the steps of feeding two steel wires in parallel with one another and spaced a certain distance apart, feeding transverse crosswise wire rods having a length exceeding the distance separating said two longitudinal wires towards and against said longitudinal wires so as to allow both ends of said crosswise wire rods to extend beyond said longitudinal wires and to ensure that said crosswise wire rods will be positioned at a certain mutual distance from one another, bending said ends of said crosswise wire rods about said longitudinal wires, and striking said bent ends with sufficient force to permanently compress the portion of the encircled longitudinal wire to effect a mechanical interlock therewith.

2. A method as claimed in claim 1 wherein the bent ends of the crosswise wire rods encompass less than 360° of the circumference of the longitudinal wires.

3. A machine for manufacturing an improved reinforcing element comprising members arranged to feed stepwise two longitudinal steel wires in parallel relationship and spaced a mutual distance apart, a device to advance equidistantly spaced transverse wire rods towards and against said longitudinal wires in a manner ensuring that said ends of said transverse wire rods extend beyond said longitudinal wires, and means to bend said ends of said transverse wire rods about said longitudinal wires and means for striking the bent ends of said transverse wire rods with sufficient force to permanently compress the portion of the encircled longitudinal wire to effect a mechanical interlock therewith.

4. The machine as claimed in claim 3, wherein said device feeding said transverse rods towards and against said longitudinal wires comprises a supply table to support a plurality of said transverse wire rods arranged in parallel, a displaceable sliding feeder means arranged for movement to and fro across the plurality of transverse wire rods supported on said sloping supply table, a sloping ramp connected to the lower edge of said supply table to feed said transverse wire rods downwards, a pusher means positioned a the lower end of said ramp to push out one transverse wire rod at a time from the plurality of transverse wire rods arranged in a row on said sloping ramp, a device to deposit said transverse wire rods on top of said two longitudinal wires, one by one, and a means to bend said ends of said transverse wire rods about their associated one of said two longitudinal wires, said means arranged to perform this operation following advancement of said wire rods one step in their longitudinal direction.

5. The machine as claimed in claim 4, comprising said pusher means arranged to perform its operative movement across said sloping ramp at the lower end thereof.

6. The machine as claimed in claim 5, comprising a guide shoulder at the lower end of said sloping ramp in position opposite thereto, said pusher means arranged to slide with its operative discharge end along the shoulder edge facing said sloping ramp in order to bring along in its sliding movement the one of said tranverse wire rods which at that moment is in the lowermost position on said ramp so as to push said rod above said guide shoulder.

7. The machine as claimed in claim 4, comprising a number of permanent magnets arranged to stop the movement of said transverse wire rods initiated by the release thereof by said pusher means.

8. The machine as claimed in claim 4, wherein said means to bend the ends of said transverse wire rods about said longitudinal wires comprise an individual wire guide for each one of said longitudinal wires, a means to releasably retain the associated transverse wire rod inside the associated one of said wire guides so as to ensure that both ends of said wire rods extend beyond said longitudinal wires, and a bending means arranged to be moved from an upper position downward along the external side of said longitudinal wires at points opposite said transverse wire rods in order to bend said two ends of said rods about their associated one of said longitudinal wires.

9. A machine as claimed in claim 3 wherein the bent ends of the crosswise wire rods encompass less than 360° of the circumference of the longitudinal wires.

10. The machine as claimed in claim 3, wherein said means to bend the ends of said transverse wire rods about said longitudinal wires comprise an individual wire guide for each one of said longitudinal wires, a means to releasably retain the associated transverse wire rod inside the associated one of said wire guides so as to ensure that both ends of said wire rods extend beyond said longitudinal wires, and a bending means arranged to be moved from an upper position downward along the external side of said longitudinal wires at points opposite said transverse wire rods in order to bend said two ends of said rods about their associated one of said longitudinal wires.

* * * * *